US006118965A

United States Patent [19]

Hirabayashi et al.

[11] Patent Number: 6,118,965

[45] Date of Patent: Sep. 12, 2000

[54] IMAGE FORMING APPARATUS HAVING A CONTACT-TYPE CHARGER

[75] Inventors: Jun Hirabayashi; Harumi Ishiyama, both of Numazu; Yasunori Chigono, Susono, all of Japan

[73] Assignee: Canon Kabushiki Kaisha, Tokyo, Japan

[21] Appl. No.: 09/175,326

[22] Filed: Oct. 20, 1998

[30] Foreign Application Priority Data

Oct. 20, 1997 [JP] Japan ..... 9-305003
May 14, 1998 [JP] Japan ..... 10-150618

[51] Int. Cl.[7] ..... G03G 15/00

[52] U.S. Cl. ..... 399/175; 399/176

[58] Field of Search ..... 399/53, 159, 162, 399/222, 265, 279, 174, 175, 176, 149, 150, 270, 267, 284

[56] References Cited

U.S. PATENT DOCUMENTS

| | | | |
|---|---|---|---|
| 4,286,543 | 9/1981 | Ohnuma et al. | 399/270 X |
| 5,185,632 | 2/1993 | Yoshida et al. | 399/284 |
| 5,367,365 | 11/1994 | Haneda et al. | 399/174 |
| 5,392,098 | 2/1995 | Ehara et al. | 399/159 |
| 5,659,861 | 8/1997 | Yamashita et al. | 399/267 |
| 5,666,192 | 9/1997 | Mashimo et al. | 399/174 |
| 5,774,769 | 6/1998 | Chigono et al. | 399/176 |
| 5,797,071 | 8/1998 | Ozawa et al. | 399/159 |
| 5,822,659 | 10/1998 | Ishiyama | 399/175 |
| 5,890,037 | 3/1999 | Kukimoto et al. | 399/175 |
| 5,937,245 | 8/1999 | Inoue et al. | 399/175 |
| 5,940,662 | 8/1999 | Hano et al. | 399/175 |
| 5,952,101 | 9/1999 | Nishiguchi et al. | 399/174 X |

FOREIGN PATENT DOCUMENTS

| | | |
|---|---|---|
| 59-149669 | 8/1984 | Japan . |
| 6-3921 | 1/1994 | Japan . |
| 7-99442 | 4/1995 | Japan . |

*Primary Examiner*—Susan S. Y. Lee
*Attorney, Agent, or Firm*—Fitzpatrick, Cella, Harper & Scinto

[57] ABSTRACT

An image forming apparatus includes an image bearing member, a charging device for charging the image bearing member, the charging device including a charging member for being supplied with a voltage and for forming a nip with the image bearing member and including electroconductive particles in the nip, a developer develops, with one-component developer, an electrostatic latent image formed on the image bearing member using the charging device; the developer including a developer carrying member for carrying the developer, wherein the developer carried on the developer carrying member during a developing operation is contacted to the image bearing member at a contact position where peripheral movement directions of the image bearing member and the developer carrying member are the same, and wherein a surface speed of the image bearing member Vd and a surface speed of the developer carrying member Vs satisfy:

$$1.2<Vs/Vd<2.5.$$

33 Claims, 4 Drawing Sheets

IMAGE FORMING APPARATUS HAVING A CONTACT-TYPE CHARGER

FIELD OF THE INVENTION AND RELATED ART

The present invention relates to an image forming apparatus such as a copying machine or printer. More specifically, it relates to an image forming apparatus equipped with a contact type charging apparatus.

In an image forming apparatus equipped with an electrophotographic system, an electrostatic recording system, or the like, an image bearing member such as an electrophotographic photosensitive member, an electrostatically recordable dielectric member, or the like, is uniformly charged (inclusive of discharging) to a predetermined polarity and a predetermined potential level, with the use of a charging apparatus. In the past, a corona type charging device (corona discharger) has been used as such a charging apparatus.

A corona type charging device is a noncontact charging apparatus. For example, it consists of a discharging electrode formed of a piece of wire or the like, and a shield electrode which surrounds the discharging electrode, In charging an image bearing member, a noncontact charging device is positioned so that the opening of the shield electrode faces the image bearing member, i.e., an object to be charged, with no contact between the charging device and the image bearing member. Then, high voltage is applied between the discharging electrode and the shield electrode to induce electric current (corona shower), to which the peripheral surface of the image bearing member is exposed. As a result, the peripheral surface of the image bearing member is charged to predetermined polarity and potential level.

In recent years, it has been proposed to employ various noncontact charging apparatuses as a charging apparatus for charging an image bearing member or the like, i.e., an object to be charged. This is due to the fact that a noncontact charging apparatus has an advantage over a corona type charging device in that the former produces less ozone, and consumes less electricity, than the latter. In fact, some of the noncontact charging apparatuses have been put to practical use.

In charging an image bearing member or the like, i.e., an object to be charged, with the use of a contact type charging apparatus, an electrically conductive charging member in the form of a roller (charge roller), a fur brush, a magnetic brush, a blade, or the like, is placed in contact with the object to be charged, and a predetermined charge bias is applied to the charging member (hereinafter, "contact charging member") so that the surface of the object to be charged is charged to predetermined polarity and potential level.

In charging an object with the use of a contact type charging system, two charging mechanisms (charging principle) work: a mechanism based on electrical discharge, and a mechanism based on charge injection. Thus, a contact type charging system displays different characteristics depending on which charging mechanism is dominant in the system.

(1) Charging Mechanism Based on Electrical Discharge

This is a charging mechanism based on the phenomenon that the surface of an object to be charged is charged by electrical discharge which occurs between a contact type charging member and the object to be charged.

In the case of this electrical discharge based charging mechanism, there exists a threshold in terms of the voltage between a contact charging member and an object to be charged, and therefore, in order to charge an object, it is necessary that the potential level of the voltage to be applied to the contact charging member be greater than the potential level to which the object is charged. Further, this charging mechanism produces active ions such as ozone, although the amount of the ions produced by this charging mechanism is far smaller than the amount of the active ions produced by a corona type charging device, and in principle, it is impossible to prevent production of such products. In other words, when this charging mechanism is used, it is impossible to completely eliminate the harm from the active ions such as ozone.

(2) Charging Mechanism Based on Charge Injection

This is a charging mechanism in which the surface of an object to be charged is charged as charge is directly injected into the object from a contact type charging member. It is called the "direct charging mechanism", "injection mechanism" or "charge injection mechanism".

More specifically, a contact charging member with an electrical resistance in the medium range is placed in contact with the surface of an object to be charged, and charge is directly injected into the object; In other words, In principle, electrical discharge does not play any role in charging the object. Therefore, even if the potential level of the voltage applied to a contact charging member is less than the threshold level, an object to be charged can be charged to a potential level equivalent to the potential level of the voltage applied to the contact charging member. Further, this charging mechanism, that is, the contact charging mechanism, is not accompanied by the production of active ions, and therefore, it does not cause problems associated with the byproducts of electrical discharge.

However, this method also suffers from a problem. That is, since electrical charge is directly injected, the charging performance of the injection charging system is significantly affected by the state of contact between a contact charging member and an object to be charged. Thus, the charging member must be placed in contact with the object to be charged, as tightly as possible, and also, a charging device must be designed so that the surface of the contact charging member and the surface of the object to be charged moves at different velocities to cause a unit area of the surface of the object to be charged, to make contact with as large an area of the surface of the contact charging member as possible.

(A) Roller Based Charging Method

As for a contact charging system for a contact type charging apparatus, a roller type charging system which employs an electrically conductive roller (charge roller) is widely used because of its reliability.

When a charge roller is used to charge an object, the aforementioned electrical discharge based charging mechanism (1) plays the dominant role in charging the object.

As for the material for a charge roller, electrically conductive rubber or foamed material, or rubber or foamed material with an electrical resistance in the medium range, is used. In some cases, these materials are placed in layers to give a charge roller desired properties.

A charge roller is given a certain degree of elasticity to maintain a desired state of contact between the charge roller and an object to be charged (hereinafter, "photosensitive member"), generating relatively large frictional resistance. Therefore, it is made to follow the rotation of the photosensitive member, or is driven so that there is only a slight velocity difference between the charge roller and the photosensitive member. Consequently, even in the case of an injection charging mechanism, it is unavoidable that the charging performance of a charging roller in absolute terms is reduced; the state of contact between the charge roller and the object to be charged becomes unsatisfactory; and/or the object is nonuniformly charged due to the irregularities on the surface of the charge roller, or the presence of foreign substances on the surface of the photosensitive member. Thus, in the case of a conventional injection system which employs a charge roller, electrical discharge plays the dominant role to charge a photosensitive member.

FIG. 5 is a graph which shows the efficiency of various charging systems. The axis of abscissas represents the potential level of the bias applied to a contact charging member, and the axis of ordinates represents the potential level to which a photosensitive member is charged.

The line A represents the characteristic of a conventional charge roller, showing that a photosensitive member is charged when the potential level of the voltage applied to the charge roller is above the threshold level, i.e., approximately −500 V. Thus, generally, in order to charge a photosensitive member to −500 V, a DC voltage with a potential level of −1000 V is applied to the charge roller, or an AC voltage with a peak-to-peak potential difference greater than the threshold potential level, for example, an AC voltage with a peak-to-peak potential difference of 1,200 V, is applied to the charging roller, in addition to the DC voltage with the potential level of −500 V, so that the potential level of the photosensitive member converges to the desired potential level, i.e., −500 V.

To describe more specifically, when a charge roller is directly pressed upon a photosensitive member based on organic photoconductor with a thickness of 25 $\mu$m, the peripheral surface of the photosensitive member is charged if a voltage with a potential level of approximately 640 V or higher is applied to the charge roller. In the region above 640 V in terms of the voltage applied to the charge roller, the surface potential of the photosensitive member is proportional to the potential level of the voltage applied to the charge roller; the relationship is linear with a gradient of 1. In this specification, this threshold potential level is defined as the firing potential level, and is represented by a referential character Vth.

In other words, in order to obtain a photosensitive member surface potential level of Vd, which is presumed necessary for electrophotography, a DC voltage with a potential level of Vd+Vth, which is higher than the potential level desired for the surface of the photosensitive member, must be applied to the charge roller. A charging method in which only DC voltage such as the above described one is applied to a contact type charging member to charge an object is called a "DC charging method".

However, in the DC charging method, the resistance value of the contact charging member is affected by the changes in ambience or the like, and also, the threshold voltage level Vth changes as the thickness of the photoconductive layer of the photosensitive member is changed by shaving. Therefore, it has been difficult to charge a photosensitive member to a potential level of a predetermined value with the use of the DC charging method.

Thus, in order to more uniformly charge a photosensitive member, an "AC charging method" is used, in which a compound voltage composed of a DC component with a desired potential level of Vd, and an AC component with a peak-to-peak potential difference of no less than 2×Vth, is applied to a contact type charging member as disclosed in Japanese Laid-Open Patent Application No. 149,669/1984. This charging method is intended for smoothing out the potential level with the use of an AC voltage, and as such a compound voltage is applied to the charge roller, the potential level to which the surface of the object to be charged converges to the potential level Vd, i.e., the center value of the peak-to-peak potential of the AC component of such a compound voltage, without being affected by external disturbances such as changes in ambience.

However, even in the case of a contact type charging apparatus, its principal charging mechanism is the electrical discharge based charging mechanism, in other words, the phenomenon that electrical discharge occurs from a contact type charging member to a photosensitive member, and therefore, the potential level of the voltage charged to the contact charging member needs to be equal to, or above, the potential level to which the peripheral surface of the photosensitive member is to be charged. Also, ozone is produced, although the amount is extremely small.

Further, if an AC charging method is used for the sake of the uniformity of the charge, problems peculiar to an AC charging method occur; the electric field generated by the AC voltage causes the contact charging member and the photosensitive member to vibrate, which causes unwanted sound (AC charging noise); the deterioration or the like of the peripheral surface of a photosensitive member is accelerated by electrical discharge.

(B) Fur Brush Based Charging Method

A fur brush based charging method employs, as a contact type charging member, a member with a brush portion composed of electrically conductive fiber (fur brush type charging device). In order to charge the peripheral surface of a photosensitive member to predetermined polarity and potential level, the electrically conductive fiber brush portion is placed in contact with the photosensitive member as an object to be charged, and a predetermined charge bias is applied to the charging member.

Also in the case of the fur brush based charging method, the electrical discharge based mechanism (1) plays the major role in charging a photosensitive member.

There are two types of fur brush type charging devices, which have been in practical use: a fixed brush type and a roller brush type. The fixed brush type charging device consists of an electrode, and a piece of cut pile formed of fiber with an intermediate electrical resistance, adhered to the electrode, and the roller brush type charging device consists of a metallic core, and a piece of the same pile as the one for the fixed brush type, wound around the metallic core. As tor the fiber density, a density of 100 strand/mm$^2$ can be relatively easily realized. However, even this level of fiber density is not enough to provide such state of contact that makes it possible to give sufficiently uniform charge to a photosensitive member through an injection based charging mechanism. Thus, in order to give a photosensitive member sufficiently uniform charge through an injection based charging mechanism, such a velocity difference that is rather difficult to achieve with the use of a mechanical structure must be provided between the surfaces of the brush portion and the photosensitive member, which is impractical.

Referring to FIG. 5, the above described fur brush based charging device, or simply a fur brush, displays the characteristic represented by a line B, in terms of the relationship between the potential level of the applied voltage and the realized potential level of a photosensitive member, when a DC voltage is applied to it. In other words, in the case of most of the fur brush based charging methods, a photosensitive member is charged through an electrical discharge based charging mechanism which applies voltage with a relatively high potential level to the fur brush, whether the fur brush is the fixed type or the roller type.

(C) Magnetic Brush Based Charging Method

A magnetic brush based charging method employs, as a contact type charging member, a member (magnetic brush type charging device) which consists of a magnetic roller or the like, and a magnetic brush portion, that is, electrically conductive magnetic particles confined magnetically in the form of a brush. In charging a photosensitive member, the magnetic brush portion is placed in contact with the photosensitive member as the object to be charged, and a predetermined charge bias is applied to the member with the magnetic brush portion to charge the peripheral surface of the photosensitive member to predetermined polarity and potential level.

As for the charging mechanism in a magnetic brush based charging method, the injection type charging mechanism (2) is the dominant charging mechanism.

In order to uniformly inject charge into a photosensitive member with the use of a magnetic brush type charging method, it is desirable that electrically conductive magnetic particles, the diameters of which range from 5 $\mu$m to 50 $\mu$m, are used as the particles for forming the magnetic brush portions and sufficient velocity difference is provided between the surfaces of the magnetic brush portion and the photosensitive member.

With this charging method, a photosensitive member can be charged to such a potential level that is substantially proportional to the potential level of an applied voltage, as shown by a line C in FIG. 5, that is, a graph which shows the characteristics of the charging method.

However, this method also suffers from problems peculiar to the method: the mechanical structure is complicated; and the electrically conductive magnetic particles which form the magnetic brush portion separate from the brush portion and adhere to the photosensitive member; and the like.

In Japanese Laid-Open Patent Application No. 3,921/1994 and the like, a contact type method which charges a photosensitive member by injecting charge into the charge holding portions of the photosensitive member, such as the traps of the peripheral surface of the photosensitive member, or the electrically conductive particles in the charge injection layer of the photosensitive member, is proposed. These methods do not rely on electrical discharge, and therefore, the potential level of the voltage to be applied to the charging member has only to be substantially equal to the potential level to which the photosensitive member is to be charged, and in addition, they do not generate ozone. Further, these methods do not require the application of AC voltage, and therefore, the aforementioned charge noise does not occur. In other words, in comparison to the roller based charging method, these methods are superior charging methods in that they do not produce ozone and consume a smaller amount of electrical power.

(D) Cleanerless Charging Method (toner recycling charging method)

In an image forming apparatus which employs a transfer type system, the toner which remains on the peripheral surface of a photosensitive member (image bearing member) after image transfer is removed from the photosensitive member by a cleaner (cleaning apparatus), becoming waste toner, which is desired to be not produced from the viewpoint of protecting the environment. Thus, a cleanerless image forming apparatus has been devised, in which a cleaner has been eliminated, and the developer remaining on the photosensitive member after image transfer (hereinafter, "residual toner") is removed by the developing apparatus; the residual toner is recovered from the peripheral surface of the photosensitive member by the developing apparatus at the same time and location as the developing apparatus develops the latent image on the peripheral surface of the photosensitive member (hereinafter, "developing/cleaning process"). The toner recovered by the developing apparatus is recycled for development.

More specifically, in the aforementioned developing/cleaning process, the developer remaining on a photosensitive member after a preceding image formation cycle is recovered by the fog removal bias (potential level difference Vback, i.e., difference between potential level of DC voltage applied to developing apparatus, and surface potential level of photosensitive member) during the following image formation cycle, that is, during the latent image developing portion of the following image formation cycle in which a latent image is formed by charging and exposing the photosensitive member. According to this developing/cleaning process, the residual developer is recovered by the developing apparatus and then is recycled for the following image formation cycle, producing no waste toner, and also, reducing the amount of labor spent for maintenance. Further, being cleanerless is advantageous also in terms of space; an image forming apparatus can be drastically reduced in size.

As described above, a cleanerless system does not remove the residual toner from the peripheral surface of a photosensitive member with the use of a dedicated cleaner, but Instead, it causes the residual toner to go to a developing apparatus through a charging station, and recycles the residual toner for development. Therefore, if a contact type charging member is employed as a means for charging the photosensitive member, developer, which is dielectric substance, will be present at the interface between the photosensitive member and the contact charging member. This presents a problem in terms of how to charge the photosensitive member to a satisfactory potential level. When a photosensitive member is charged with the use of the aforementioned roller or fur brush, the toner which remains on the photosensitive member, usually in a certain pattern, after image transfer, is scattered to make it lose the pattern. Also, the photosensitive member is charged through electrical discharge caused by the application of a bias with a high potential level. In comparison, when a photosensitive member is charged with the use of a magnetic brush, particles confined in the form of a brush are used as the contact charging member. Therefore, the magnetic brush portion constituted of the particles, i.e., the electrically conductive magnetic particles, makes contact with the photosensitive member, conforming to the contour of the photosensitive member, which renders this charging method advantageous. However, even this method suffers from its own disadvantages: it requires a complex structural design, and also, the electrically conductive magnetic particles which form the magnetic brush portion separate from, or fall off, the magnetic brush portion, which creates a serious problem.

(E) Coating of Particles on Contact Charging Member

Japanese Patent Publication Application No. 99,442/1995 discloses a contact type charging apparatus, which features a structure designed to coat powder on the peripheral surface of a contact charging member, on the portion in contact with the peripheral surface of an object to be charged, in order to uniformly and reliably charge a photosensitive member. According to this structural design, the contact charging member (charge roller) is caused to follow (no difference in peripheral velocity) the rotation of the object to be charged (photosensitive member), and the amount of the ozonic products it produces is remarkably small in comparison to those produced by a corona type charging device such as Scorotron.

Further, U.S. Pat. No. 5,432,037 discloses an image forming method based a contact type charging system, which also addresses the aforementioned charging problem. According to this method, in order to prevent the phenomenon that, as an image formation cycle is repeated for a long time for image formation, toner particles and/or microscopic silica particles adhere to the surface of a charging member and interfere with a charging process, the developer is composed of at least toner particles, and the electrically conductive particles, the average size of which is smaller than that of toner particles However, in practice, the aforementioned powder or electrically conductive particles fell out of the nip between a charging member, and an image bearing member, i.e., an object to be charged, and adhered to the image bearing member. As a result, image defects such as fog sometimes appeared as latent images were developed.

SUMMARY OF THE INVENTION

The primary object of the present invention is to provide an image forming apparatus which does not produce defective images even If electrically conductive particles adhere to the image bearing member.

Another object of the present invention is to provide an image forming apparatus which recovers, by the developing apparatus, the electrically conductive particles having adhered to the image bearing member.

Another object of the present invention is to provide an image forming apparatus which prevents the development process from producing foggy images.

Another object of the present invention is to provide an image forming apparatus capable of reusing the electrically conductive particles which have fallen out of the nip between the charging member and the image bearing member.

Another object of the present invention is to provide an image forming apparatus which injects electrical charge into the image bearing member through the nip between the image bearing member and the charging member, without producing ozone.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
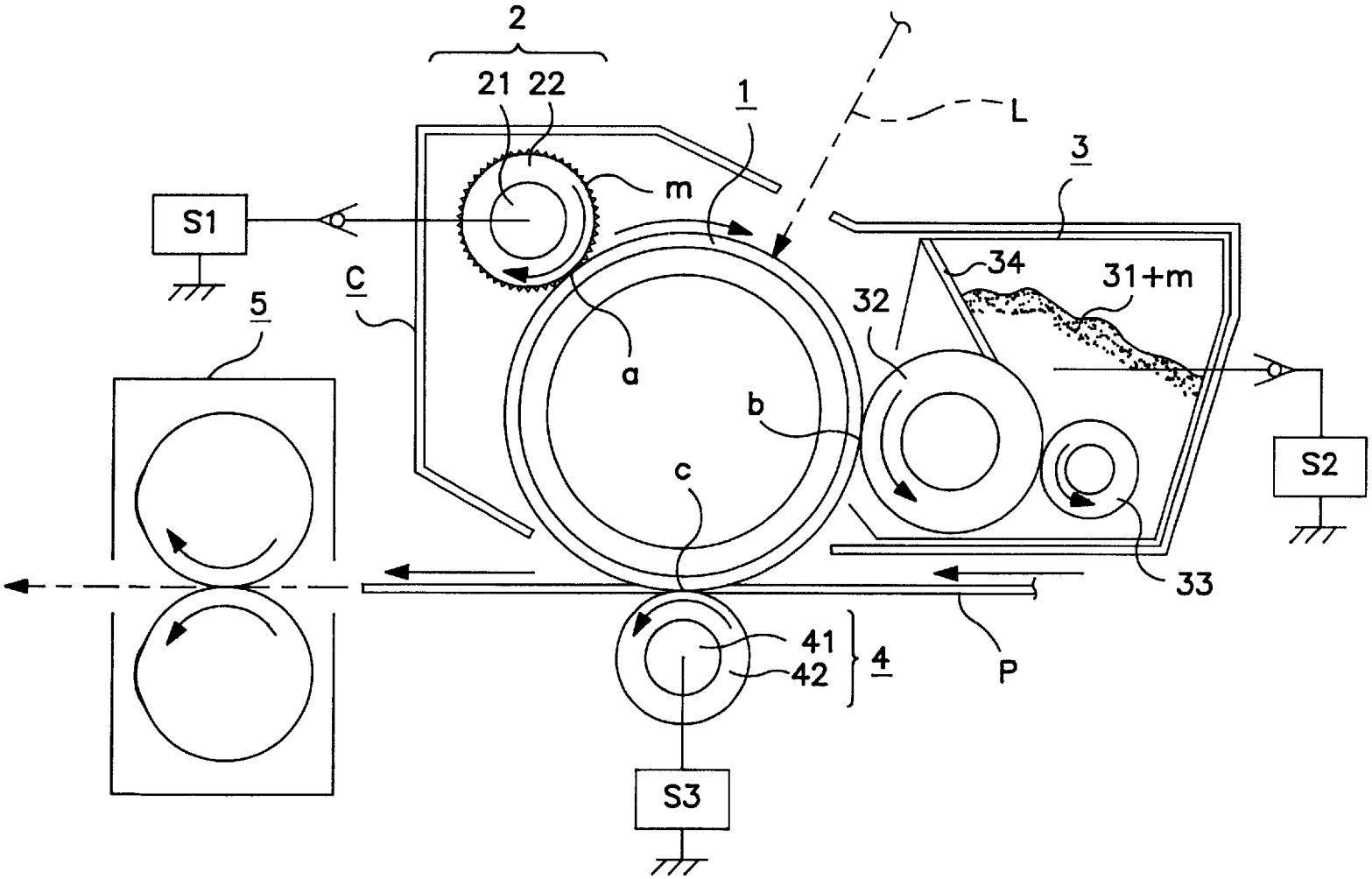
FIG. 1 is a schematic section of the image forming apparatus in the first embodiment of the present invention, and depicts the general structure thereof.

Embodiment 1 (FIG. 1)

FIG. 1 is a schematic section of an example of an image forming apparatus in accordance with the present invention, and depicts the general structure thereof.

The image forming apparatus in this embodiment is a laser printer, which employs a transfer type electrophotographic process, a contact type charging system, a reversal development system, a cleanerless system, and a process cartridge system.

In this image forming apparatus, electrically conductive charging performance enhancement particles are interposed between the contact type charging ember and the image bearing member, in the charging station, that is, the nip between the two members, which are electrically conductive, so that electrical charge is injected into the image bearing member.

Further, a contact type developing apparatus is employed as the developing means.

Further, in order to facilitate the recovery of the charging performance enhancement particles from the peripheral surface of the image bearing member into the developing apparatus, a velocity difference is provided between the peripheral surface of the developer bearing member, which bears the developer, and the peripheral surface of the image bearing member.

(1) General Structure of Printer

[Image Bearing Means]

Referring to FIG. 1, a referential FIG. 1 designates an electrophotographic photosensitive member in the form of a rotative drum, as the image bearing member (object to be charged). This printer in this embodiment employs a reversal development system. The photosensitive member 1 has an organic photoconductive layer, and is charged to negative polarity. Its diameter is 30 mm, and it is rotatively driven in the clockwise direction indicated by an arrow mark, at a peripheral velocity of 94 xmm/sec.

[Charging Means]

Figure 2:
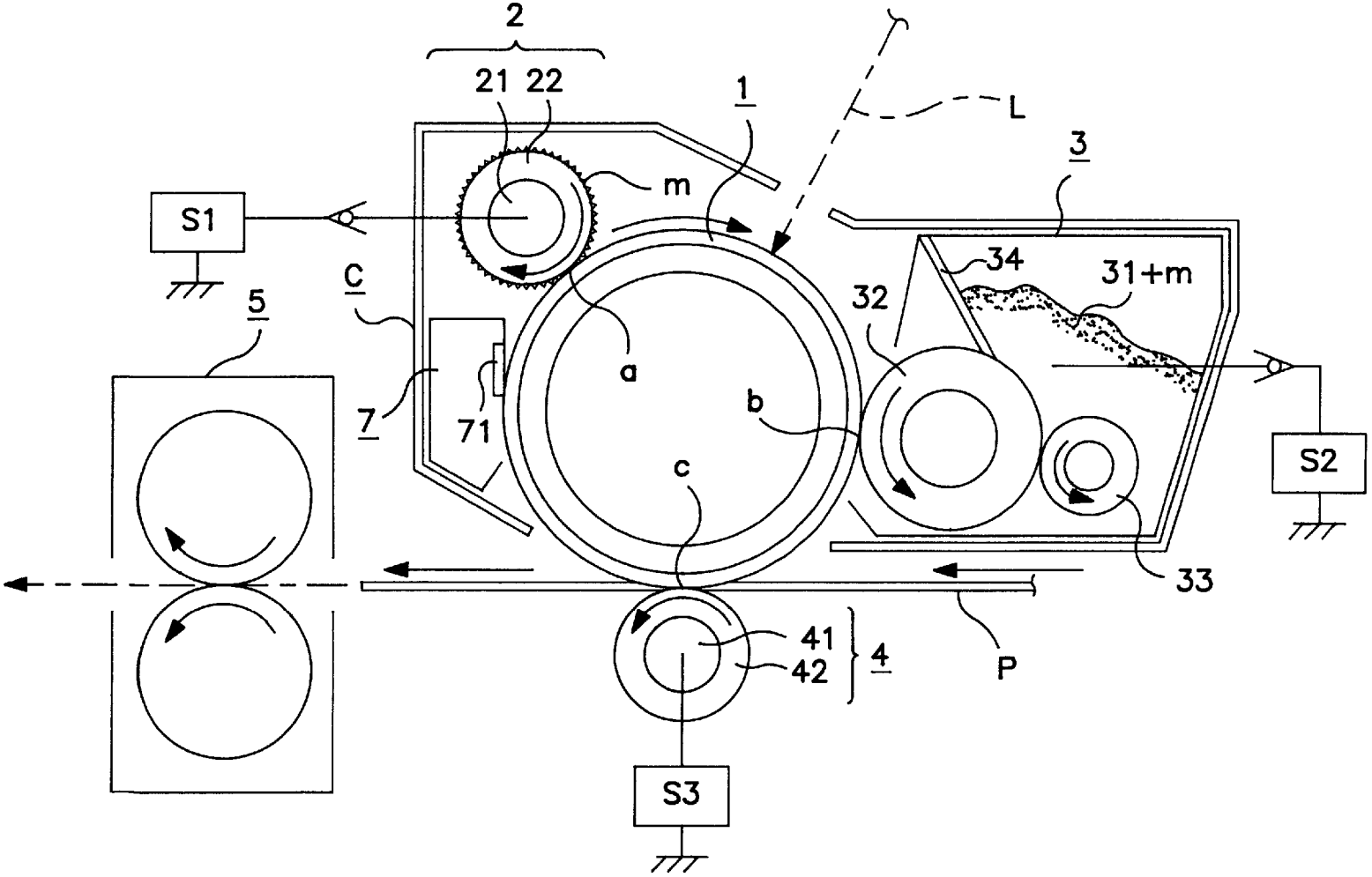
FIG. 2 is a schematic section of the image forming apparatus in the second embodiment of the present invention, and depicts the general structure thereof.

A referential FIG. 2 designates an electrically conductive elastic roller (charge roller), as an elastic contact type charging member, which is placed in contact with a photosensitive member 1 with a predetermined contact pressure. A referential character a designates the charging station, that is, the nip portion between the photosensitive member 1 and the charge roller 2. The peripheral surface of the charge roller 2 is coated in advance with charging performance enhancement particles m, and the charging performance enhancement particles m are present also in the charging station a.

The charge roller 2 in this embodiment is rotatively driven at a peripheral velocity equivalent to 100% of the peripheral velocity of the photosensitive member 1, in such a direction that the rotational direction of its peripheral surface in the nip a becomes opposite (counter) to the rotational direction of the photosensitive member 1 in the nip a, providing a peripheral velocity difference between the peripheral surfaces of the charge roller 2 and the photosensitive member 1. To this charge roller 2, a predetermined charge bias is applied from a charge bias power source S1, whereby the peripheral surface of the photosensitive member 1 is uniformly charged to predetermined polarity and potential level by the charge injection mechanism. In this embodiment, a charge bias is applied to the charge roller 2 from the charge bias power source S1 so that the peripheral surface of the photosensitive member 1 is uniformly charged to an approximate potential level of −700 V. The charge roller 2, the charging performance enhancement particles m, the charge injection system, and the like, will be described in separate sections.

[Exposing Means]

The charge surface of the photosensitive member 1 is exposed to a scanning laser beam L projected from an unillustrated laser beam scanner, which comprises a laser diode, a polygon mirror, and the like. The laser beam projected from the laser beam scanner is such a laser beam that has been modulated in intensity with the sequential electrical digital signals which reflect the image data of a target image. As the charged peripheral surface of the photosensitive member 1 is exposed to the scanning laser beam L, an electrostatic latent image which reflects the image data of the target image is formed on the peripheral surface of the photosensitive member 1.

In this embodiment, a reversal development system is employed. In other words, the portions of the peripheral surface of the photosensitive member 1, which have been exposed to the scanning laser beam, are the portions to which the toner is to adhere, and the portions of the peripheral surface of the photosensitive member 1 which have not been exposed, are the portions to which the toner is not to adhere.

[Developing Means]

Figure 3:
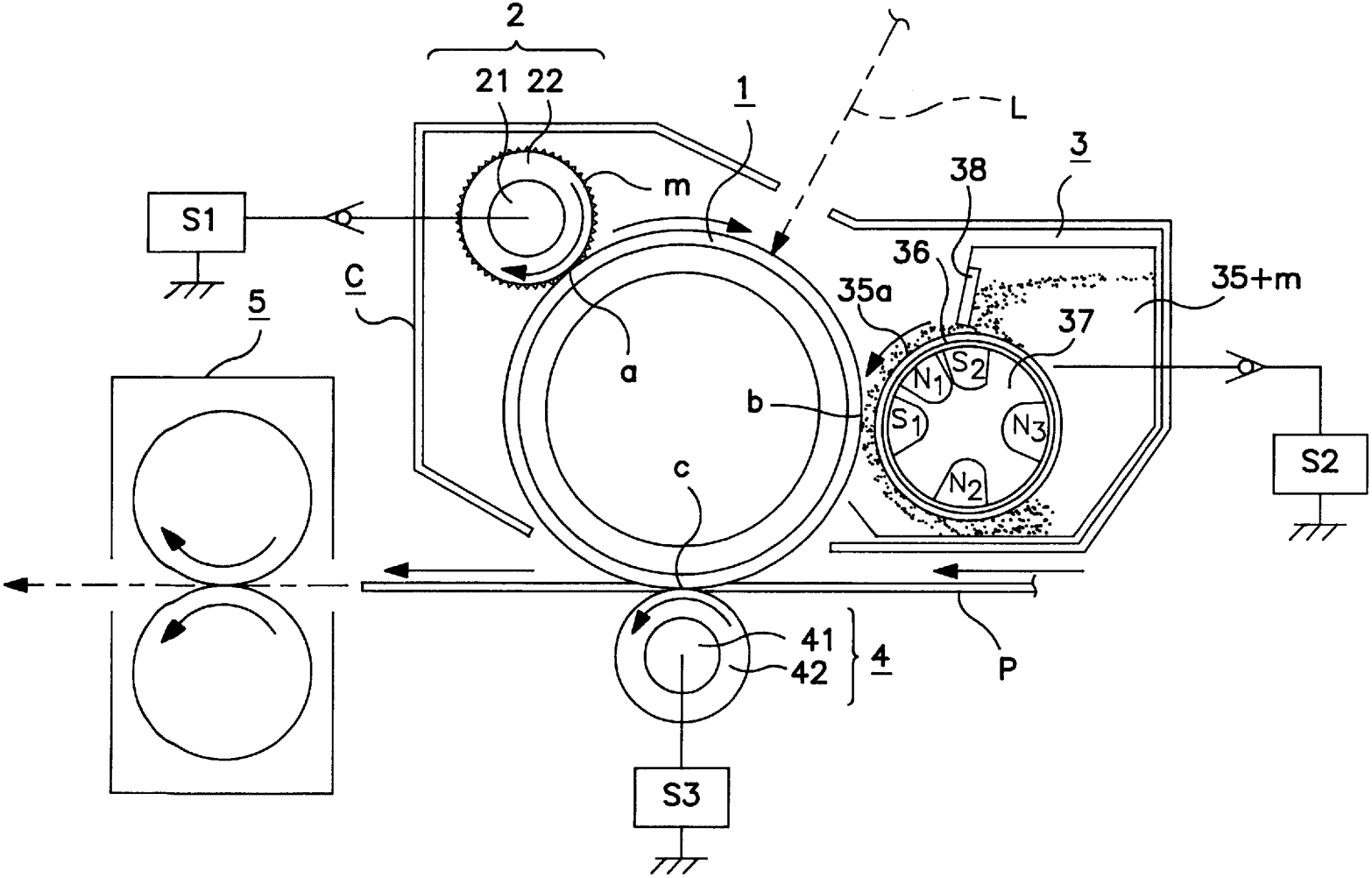
FIG. 3 is a schematic section of the image forming apparatus in the third embodiment of the present invention, and depicts the general structure thereof.

A referential FIG. 3 designates a developing apparatus. The aforementioned electrostatic latent image formed on the peripheral surface of the photosensitive member 1 is developed in reverse into an image composed of developer (toner image); the developer (toner) adheres to the exposed portions.

The developing apparatus 3 in this embodiment is a contact type developing apparatus, and uses negatively chargeable, nonmagnetic, dielectric developer 31 composed of a single component. The average particle diameter of the developer 31 is 7 $\mu$m.

A reference FIG. 32 designates an elastic development roller (elastic development sleeve), as a developer bearing/conveying member, with a diameter of 16 mm. The aforementioned developer 31 is coated on the peripheral surface of this development roller 32. The development roller 32 is placed in contact with the photosensitive member 1 so that the width of the contact nip formed between the peripheral surfaces of the development roller 32 and the photosensitive member 1 remains at 2 mm. It is rotated at a peripheral velocity equivalent to 180% of the peripheral velocity of the photosensitive member 1 in such a direction that its rotational direction in the nip (development station) becomes the same as the rotational direction of the photosensitive member 1 in the nip. To this development roller 32, a development bias is applied from a development bias power source 2.

The developer 31 in the developing apparatus gains triboelectrical charge as it is caused to rub against the elastic blade 34; it is electrically charged to a certain potential level. As for the delivery of the developer 31 to the development roller 32, it is done by a delivery roller 33, which is rotated at a peripheral velocity equivalent to 90% of the peripheral velocity of the development roller 32, in such a direction that its rotational direction at the contact point between the delivery roller 33 and the development roller 32 becomes opposi'te to the rotational direction of the delivery roller 33 at the contact point between the rollers 32 and 33.

The development bias applied to the development roller 32 to cause latent image development to occur between the development roller 32 and the photosensitive member 1 is a DC voltage with a potential level of −420 V.

[Transferring Means]

Figure 4:
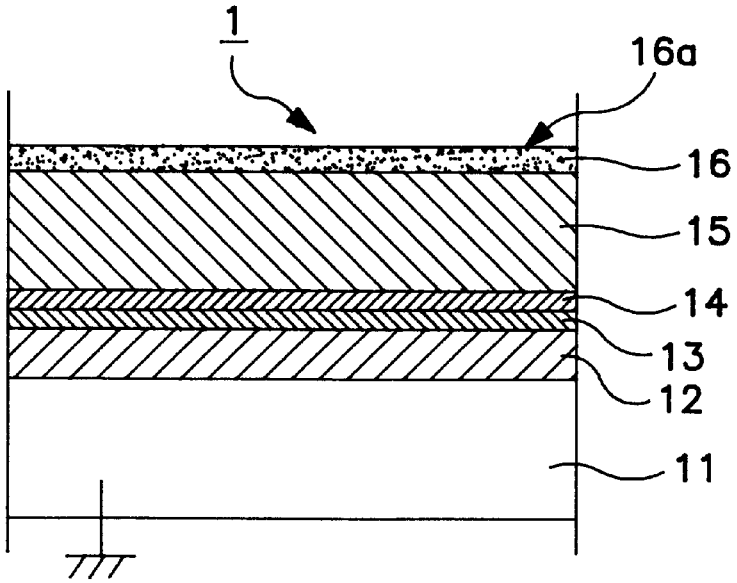
FIG. 4 is a schematic section of an example of a photosensitive member, the top surface layer of which constitutes a charge injection layer.

A referential FIG. 4 designates a transfer roller, as a contact type transferring means, the electrical resistance of which is in the medium range. It is placed in contact with the photosensitive member 1 with a predetermined pressure, forming a transfer station c. To this transfer station c, a sheet of transfer material P as recording medium is delivered with a predetermined timing from an unillustrated sheet feeding station. As the transfer sheet P is passed through the transfer station c, a predetermined transfer bias is applied to the transfer roller 4 from a transfer bias power source S3, whereby the image which has been composed of the developer, on the peripheral surface of the photosensitive member 1, is continuously transferred onto the transfer sheet P, starting from the leading end toward the trailing end More specifically, the transfer roller 4 employed in this embodiment consists of a metallic core 41, and an elastic layer 42 which covers the peripheral surface of the metallic core 41. The electrical resistance of the elastic layer 42 is in the medium range, and the resistance value of the transfer roller 4 is $5\times10^8$ Ω. In order to cause the transfer to occur, a DC voltage with a potential level of +3,000 V is applied to the metallic core 41. After being delivered to the transfer station c, the transfer sheet P is introduced into the transfer station c, and then is passed through it, being pinched by the transfer roller 4 and the photosensitive member 1. While the transfer sheet P is passed through the transfer station c, the image composed of the developer (hereinafter, developer image), which is borne on the peripheral surface of the photosensitive member 1, is continuously transferred onto the transfer sheet P, on the side which faces the photosensitive member 1, by the electrostatic force and the mechanical pressure, starting from the leading end toward the trailing end.

[Fixing Means]

Figure 5:
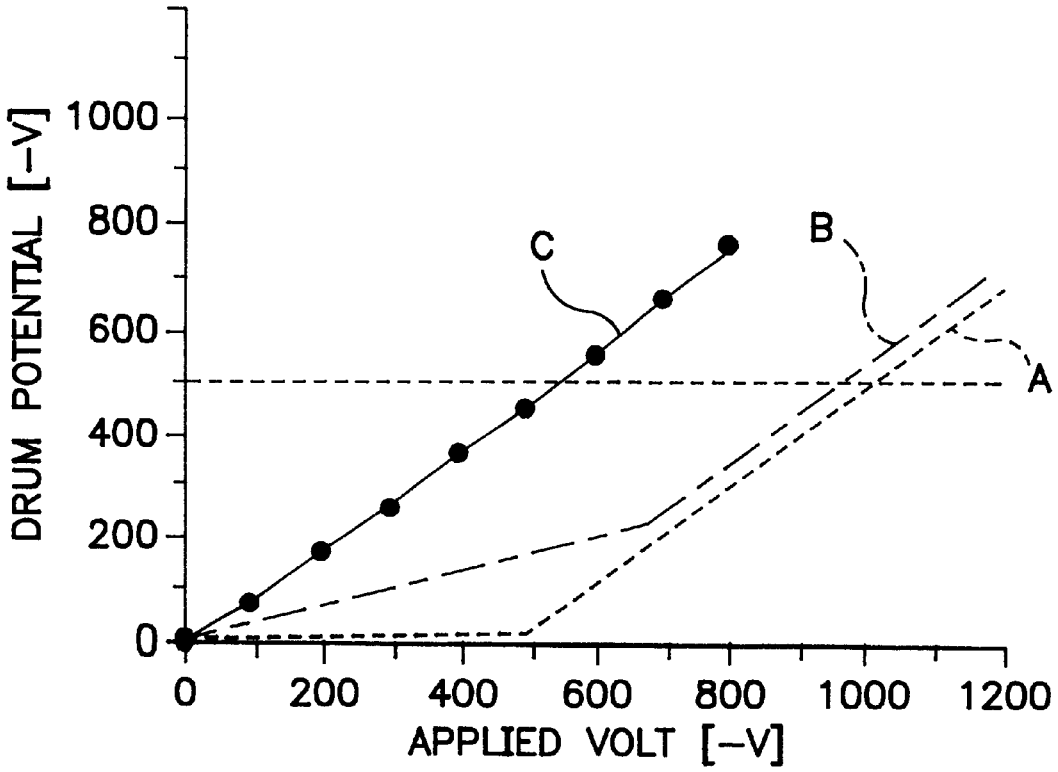
FIG. 5 is a graph which shows the performance of various charging members.

A referential FIG. 5 designates a fixing apparatus which employs a thermal fixing system . After being put through the transfer station c while receiving the developer image from the photosensitive member 1, the transfer sheet P is separated from the peripheral surface of the photosensitive member 1, and then is introduced into the fixing apparatus 5, in which the developer image is fixed to the recording sheet P. Thereafter, the transfer sheet P is discharged as a print or a copy from the main assembly of the image forming apparatus.

[Process Cartridge]

The printer in this embodiment employs a process cartridge C, which consists of three processing apparatuses, that is, the photosensitive member 1, the charge roller 2, and the developing apparatus 3, and a housing in which these processing apparatuses are integrally disposed The process cartridge C is removably installable in the main assembly of the image forming apparatus. The choice, combination, and the like, of the processing apparatuses to be disposed in the process cartridge C do not need to be limited to those described above.

(2) Charge Roller 2

The charge roller 2 as an elastic contact type charging member in this embodiment consists of a metallic core 21, and a layer 22 of rubber or foamed material which covers the peripheral surface of the metallic core 21. The electrical resistance of the surface layer 22 is in the medium range.

More specifically, the medium resistance layer 22 is composed of resin (for example, urethane), electrically conductive particles (for example, carbon black), sulfurizing agent, foaming agent, and the like. It is formed on the peripheral surface of metallic core 21, in the form of a roller. Then, the peripheral surface of the layer 22 is polished.

It is essential that the charge roller 2 as the contact charging member functions as an electrode. In other words, not only must the charge roller 2 be provided with elasticity so that it can make satisfactory contact with the object to be charged, but It also must have an electrical resistance low enough to charge the object to be charged, which is moving. On the other hand, if pin holes or the like, that is, portions defective in terms of electrical resistance, are present in the object to be charged, the charge roller 2 must be able to prevent voltage leak. Thus, when the object to be charged is an electrophotographic photosensitive member, the electrical resistance of the charge roller 2 is desired to be in a range of $10^4$–$10^7$ Ω, so that satisfactory charging performance can be realized while preventing voltage leak.

It is desirable that the peripheral surface of the charge roller 2 is provided microscopic irregularities so that it can retain the charging performance enhancement particles m. Thus, the outermost surface of the charge roller 2 is desired to be composed of foamed material.

As for the hardness of the charge roller 2, if it is too low, the shape of the charge roller 2 becomes unstable, rendering unstable the state of contact between the charge roller 2 and the object to be charged, whereas if the hardness level is too high, not only can it not assure that the charging nip a is satisfactorily formed between the charge roller 2 and the object to be charged, but also it renders the state of contact between the charge roller 2 and the object to be charged, inadequate on the microscopic level. Thus, the desirable hardness range for the charge roller 2 is from 25° to 50° in Asker C scale.

The material for the charge roller 2 does not need to be limited to foamed elastic material. For example, as for the elastic material for the charge roller 2, EPDM, urethane, NBR, silicone rubber, IR, or the like, in which an electrically conductive substance such as carbon black or metallic oxide is dispersed to adjust the electrical resistance, may be listed. Also, their foamed versions may be listed. It should be noted here that the electrical resistance may be adjusted by using ion-conductive material instead of dispersing electrically conductive substance.

The charge roller 2 is placed in contact with the photosensitive drum 1, with a predetermined amount of pressure, forming the charging nip, i.e., a charging station a, as the elastic surface layer of the charge roller 2 is pressed against the peripheral surface of photosensitive drum 1, In this embodiment, the width of the charging station a is several millimeters.

The electrical resistance of the charge roller 2 was measured in the following manner: the photosensitive drum 1 of the printer was replaced with an aluminum drum. Then, while 100 V was applied between the aluminum drum and the metallic core 21 of the charge roller 2, the current which was flowing between them was measured. Then, the electrical resistance of the charge roller 2 was obtained from the thus obtained current value. The thus obtained electrical resistance value of the charge roller 2 employed in this embodiment was $5\times10^6$ Ω. The measurement was made in an environment in which temperature was 25° C. and humidity was 30%.

(3) Charging Performance Enhancement Particles m

In this embodiment, electrically conductive zinc oxide particles with a specific resistivity of $10^7$ Ω·cm and an average particle diameter of 2.5 μm are used as the electrically conductive charging performance enhancement particles m to be coated on the peripheral surface of the charge roller 2.

The charging performance enhancement particles may be in the primary form, or in the secondary form, i.e., in an agglomerated state; it does not matter whether they are in the primary or secondary form. In other words, no matter what degree of agglomeration they are in, the degree of agglomeration does not matter as long as they can efficiently perform as the charging performance enhancement particles.

As for the particle diameter, if the particles are in an agglomerated state, it is defined as the average diameter of the secondary particles. The particle diameter was determined using the following method: no fewer than 100 particles were picked using an optical or electron microscope, and the distribution of their volumetic particle size was calculated based on their horizontal maximum cord length. Then, the fifty percentile average horizontal maximum cord length was used as the value for the particle diameter of the charging performance enhancement particles in this embodiment.

When the electrical resistance of the charging performance enhancement particles m was no less than $10^{12}$ Ω·cm, charging performance was unsatisfactory. Thus, the electrical resistance of the peripheral surface is desired to be no more than $10^{12}$ Ω·cm. more desirably, $10^{10}$ Ω·cm. In this embodiment, charging performance enhancement particles with an electrical resistance of $1\times10^7$ Ω·cm was used. The electrical resistance of the charging performance enhancement particles in this embodiment was determined in the following manner: approximately 0.5 g of the charging performance enhancement particles was placed in a cylindrical container with a cross section size of 2.26 $cm^2$, and then, the electrical resistance of this sample was measured while applying 100 V and 15 kg through the top and bottom electrodes. Then the value obtained by normalizing the thus obtained resistance value of the sample was used as the specific resistance of the charging performance enhancement particles in this embodiment.

The charging performance enhancement particles m are desired to be white or transparent, and also nonmagnetic, so that they do not interfere with the exposing process. Further, in consideration of the fact that a certain amount of the charging performance enhancement particles is transferred from the photosensitive member onto the recording sheet P, the charging performance enhancement particles to be used for color recording are desired to be white or transparent. Further, in consideration of the fact that unless the particle diameter of the charging performance enhancement particles was approximately no more than ½ the diameter of the particle diameter of the developer 31, the charging performance enhancement particles interfered with the exposing process, the particle diameter of the charging performance enhancement particles m is desired to be less than ½ the particle diameter of the developer 31. As for the minimum value for the particle diameter of the charging performance enhancement particle, it is thought to be 10 nm in consideration of the stability of the charging performance enhancement particles.

As for the material for the charging performance enhancement particles m, zinc oxide is used in this embodiment. However, the choice does not need to be limited to zinc oxide. It may be one of the other electrically conductive inorganic metallic oxides, such as alumina, or it may be a mixture of inorganic and organic substances. Further, the charging performance enhancement particles may be given surface treatment.

(4) Charge Injecting Process

1. If the charge roller 2, i.e., the contact charging member, is placed directly in contact with the photosensitive member 1, i.e., the image bearing member, forming a charging nip between them, the presence of a large mount of frictional resistance generated between them makes it difficult to rotate the charge roller 2 while maintaining a peripheral velocity difference relative to the photosensitive member 1. This problem can be solved by interposing the charging performance enhancement particles m between the photosensitive member 1 and the charge roller 2, in the nip. In other words, the lubricating effect of the charging performance enhancement particles m makes it possible to easily rotate the charge roller 2 virtually in contact with the peripheral surface of the photosensitive member 1 while maintaining the peripheral velocity difference relative to the photosensitive member 1. In addition, the interposition of the charging performance enhancement particles m between the charge roller 2 and the photosensitive member 1 tightens the state of the contact between the peripheral surfaces of the charge roller 2 and the photosensitive member 1, causing a unit area of the peripheral surface of the photosensitive member 1 to come in contact with a greater area of the peripheral surface of the charge roller 2.

Further, maintaining a sufficient amount of peripheral velocity difference between the charge roller 2 and the photosensitive member 1 drastically increases the frequency at which the charging performance enhancement particles m contact the photosensitive member 1, in the nip between the charge roller 2 and the photosensitive member 1, and therefore, the state of the contact between the charge roller 2 and the photosensitive member 1 is drastically improved. In other words, the charging performance enhancement particles m interposed between the charge roller 2 and the photosensitive member 1, in the nip formed by the two, rub the peripheral surface of the photosensitive member 1, leaving virtually no gap between the two, making it possible for electrical charge to be directly injected into the photosensitive member 1 with a high level of efficiency. Thus, as the charging performance enhancement particles m are interposed between the charge roller 2 and the photosensitive member 1, the process of electrically charging the photosensitive member 1 is dominated by the charge injection mechanism.

The peripheral velocity difference is provided by driving the charge roller 2 independently from the photosensitive member 1. In order to temporarily transfer the residual developer, that is, the toner which has remained on the photosensitive member 1 and has been carried to the charging station a, onto the charge roller 2, the image forming apparatus is desired to be structured so that the charge roller 2 is rotatively driven independently from the photosensitive member 1, and the moving direction of the peripheral surface of the charge roller 2 in the charging station a becomes opposite to that of the photosensitive member 1. This is due to the following reason: the counter rotation of the charge roller 2 temporarily strips the developer, which has remained on the photosensitive member 1 after image transfer, away from the photosensitive member 1, allowing electrical charge to be far more efficiently injected into the photosensitive member 1.

As the toner adheres to the charge roller 2, the difference between the potential level of the voltage applied to the charge roller 2, and the potential level of the photosensitive member 1, becomes larger, and this difference in potential level generates an electric field which causes the toner to return from the charge roller 2 to the photosensitive member 1.

Therefore, such a high charging efficiency can be achieved that could not be done with the use of a conventional charging member or the like; it is possible to charge the photosensitive member 1 to substantially the same potential level as the potential level of the voltage applied to the charge roller 2. Thus, according to this embodiment, even when the charge roller 2 is used as the contact type charging member, the potential level of the bias, that is, the voltage, necessary to be applied to the charge roller 2 to charge the photosensitive member 1, has only to be equivalent to the potential level to which the photosensitive member 1 is to be charged, making it possible to realize a stable and safe charging system, or an apparatus, of a contact type, which does not depend on electrical discharge.

As for the amount of the charging performance enhancement particles m interposed between the photosensitive member i as the image bearing member, and the charge roller 2 as the contact type charging member, if the amount is too small, the lubricating effect of the particles m is insufficient, allowing the friction between the charge roller 2 and the photosensitive member 1 to remain great, and therefore, it is difficult to rotatively drive the charge roller 2 while maintaining a predetermined amount of peripheral velocity difference relative to the photosensitive member 1. In other words, an excessive torque is necessary. Further, if the charge roller 2 is forcefully rotated, the peripheral surfaces of the charge roller 2 and/or the photosensitive member 1 are excessively shaved. Further, without the charging performance enhancement particles m, it does not occur that the amount of the contact a unit area of peripheral surface of the photosensitive member 1 makes with the charge roller 2 is increased by the presence of the charging performance enhancement particles m. On the other hand, if the amount of the charging performance enhancement particles m interposed between the two is excessively large, too many charging performance enhancement particles m fall off the charge roller 2, adversely affecting the image formation.

According to tests, the a-mount of the charging performance enhancement particles m to be interposed between the charge roller 2 and photosensitive member 1 is desired to be in a range of $10^3$–$5\times10^5$ particle/mm$^2$. If it is no more than $10^3$ particle/mm$^2$, the lubricating effect of the charging performance enhancement particles is not sufficient, and also, the amount of the contact between a unit area of the peripheral surface of the photosensitive member 1, which the charging performance enhancement particles increases, is not sufficient. Therefore, the increase in charging performance is not sufficient.

The more desirable amount of the interposition of the charging performance enhancement particles m is in a range of $10^3$–$5\times10^5$ particle/mm$^2$. If the amount exceeds $5\times10^5$ particle/mm$^2$, the amount by which the charging performance enhancement particles m fall off the charge roller 2 onto the photosensitive member 1 is excessive, causing the underexposure of the photosensitive member 1 regardless of the degree of optical transparency of the particles m themselves. If it is no more than $5\times10^5$ particle/mm$^2$, the amount by which the charging performance enhancement particles fall off remains small, minimizing the adverse effect of the charging performance enhancement particles. The actually measured amount of the charging performance enhancement particles which fell onto the photosensitive member 1 when the amount, by which the charging performance enhancement particles were interposed, was kept in the aforementioned desirable range, was $10^2$–$10^5$ particle/mm$^2$, and therefore, in order to prevent the charging performance enhancement particles from adversely affecting the image formation, the amount by which the charging performance enhancement particles are interposed is desired to be no more than $10^5$ particle/mm$^2$.

Next, the method for measuring the amount by which the charging performance enhancement particles are interposed, and the amount of the charging performance enhancement particles on the photosensitive member 1, will be described. The amount by which the charging performance enhancement particles are interposed between the charge roller 2 and the photosensitive member 1 is desired to be measured directly at the charging nip n. However, most of the charging performance enhancement particles present on a certain portion of the photosensitive member 1 before this portion comes in contact with the charge roller 2, were stripped away by the charge roller 2, the peripheral surface of which moves in the direction opposite to the peripheral surface of the photosensitive member 1. Therefore, in the present invention, the amount of the charging performance enhancement particles present on a certain portion of the peripheral surface of the charge roller 2 prior to the arrival of this portion of the charge roller 2 to the charging nip n was defined as the official amount of the charging performance enhancement particles m interposed in the charging nip n. More specifically, the rotation of the photosensitive drum 1 and charge roller 2 was stopped while the charge bias was not being applied. Then, the peripheral surfaces of the photosensitive member 1 and the charge roller 2 were photographed with a video-microscope (OVM1000N: Olympus) and a digital still recorder (SR-3100: Deltis) in the following manner. In the case of the charge roller 2, the charge roller 2 was placed in contact with a piece of slide glass in the same condition as it was placed in contact with the photosensitive member 1, and no fewer than 10 locations of the interface between the charge roller 2 and the slide glass were photographed from behind the slide glass with the video-microscope equipped with an object lens with a magnification of 1,000 times. Then, in order to divide the thus obtained digital image into the cells with a single charging performance enhancement particle and the cells with no charging performance enhancement particle, the digital image was binarized with the use of a certain threshold value, and the number of cells with a charging performance enhancement particle was counted with the use of a predetermined image processing software.

As for the amount of the charging performance enhancement particles on the photosensitive member 1, the peripheral surface of the photosensitive member 1 was photographed with the video-microscope, and the obtained digital image was processed, in the same manner as the peripheral surface of the charge roller 2 was photographed and processed.

2. In the case of a cleanerless image forming apparatus, that is, an image forming apparatus which does not comprise a dedicated cleaner, the developer which remains on the peripheral surface of the photosensitive member 1 after image transfer is directly carried to the charging station a, that is, the nip between the photosensitive member 1 and the charge roller 2, by the movement of the peripheral surface of the photosensitive member 1.

In this case, placing the charge roller 2 in contact with the photosensitive member 1 while maintaining a peripheral velocity difference between the two can disturb, or delete, the pattern formed by the residual developer on the photosensitive member 1, preventing therefore the pattern of the image formed in the preceding image formation cycle from appearing as a ghost in the half tone regions of the image being currently formed.

3. The residual developer carried to the charging station a adheres to the charge roller 2 or mixes with the developer borne on the charge roller 2. Usually, developer is dielectric substance, and therefore, if it remains on the photosensitive member 1 after image transfer, and adheres to the charge roller 2 or mixes into the developer borne on the charge roller 2, it causes the photosensitive member 1 to be insufficiently charged.

However, the presence of the charging performance enhancement particles m between the photosensitive member 1 and the charge roller 2, in the charging station a. i.e., the nip between the photosensitive member 1 and charge roller 2, tightens the state of the contact between the charge roller 2 and the photosensitive member 1, and also keeps the frictional resistance between the charge roller 2 and the photosensitive member 1, sufficiently low. Therefore, in spite of the contamination of the charge roller 2 by the residual developer, electrical charge can be directly injected into the photosensitive member 1 to uniformly charge the photosensitive member 1 to a satisfactory potential level, without generating ozone, by applying a charge bias with a relatively low potential level, for a long period of time.

4. The residual developer having adhered to the charge roller 2 or having mixed with the developer on the charge roller 2 is gradually purged onto the photosensitive member 1, and Is carried to the developing station b by the movement of the peripheral surface of the photosensitive member 1. Then, in the developing station D, the residual developer is leaned (recovered) by the developing apparatus 3 at the same time as the latent image on the photosensitive member 1 is developed (toner recycling).

The presence of the charging performance enhancement particles m on the charge roller 2 reduces the strength of the force which causes the residual toner to adhere to the charge roller 2 or mix with the developer on the charge roller 2, improving therefore the efficiency with which the residual developer is purged from the charge roller 2 onto the photosensitive member 1.

As described previously, the developing/cleaning process by the developing apparatus 3 occurs in the following manner: after image transfer, the photosensitive member 1 is charged, with the toner remaining on the photosensitive member 1, and a latent image is formed by exposing the charged peripheral surface of the photosensitive member 1. Then, while the latent image is developed, the residual toner on the photosensitive member 1 is recovered into the developing apparatus 3 by the fog preventing potential difference Vback, i.e., the difference between the potential level of the DC voltage applied to the developing apparatus 3, and the surface potential level of the photosensitive member 1. When a latent image is developed in reverse as in the printer in this embodiment, the developing/cleaning process is carried out by the electric field which moves the toner from the portions of the photosensitive member 1 with the potential level correspondent to the dark portion, to the development sleeve, and the electric field which adheres toner from the development sleeve onto the portions of the photosensitive member 1 with the potential level correspondent to the light portion.

5. The presence of the charging performance enhancement particles m on the photosensitive member 1, being virtually adhered to the photosensitive member 1, improves the efficiency with which developer is transferred from the photosensitive member 1 onto the transfer sheet P.

(5) Prevention of Fog Traceable to Charging Performance Enhancement Particles

1. As described above, in a system in which the charging performance enhancement particles m are interposed between the charge roller 2, i.e., the contact type charging member, and the photosensitive member 1, i.e., the image bearing member, in the charging station a, i.e., the nip between the charge roller 2 and the photosensitive member 1, the charging performance enhancement particles m escape from the charging station a, and are carried to the developing station b by adhering to the peripheral surface of the photosensitive member 1. If these charging performance enhancement particles m being carried to the developing station b have been electrically charged (for example, if charging performance enhancement particles are zinc oxide particles), an electrical field is formed between the charging performance enhancement particles m and the photosensitive member 1. Thus, if these electrically charged charging performance enhancement particles m remain adhered to the peripheral surface of the photosensitive member 1, the immediate adjacencies of the electrically charged charging performance enhancement particles m are developed by the developer; the developer adheres to the immediate adjacencies of the spots of the photosensitive member 1 with the charging performance enhancement particles m. If the locations of these spots on the photosensitive member 1 happen to correspond to the white portions of an image being formed, a foggy image is produced.

In this embodiment, the contact type developing apparatus 3 is employed as the developing means. Therefore, the aforementioned fog is not likely to occur. More specifically, the charging performance enhancement particles m, which have escaped from the charging station a, have adhered to the photosensitive member 1, and have been carried to the developing station b, come in contact with the developer borne on the development roller 32, in the developing station a. Then, as the developer borne on the development roller 32 rubs the peripheral surface of the photosensitive member 1, the charging performance enhancement particles m on the peripheral surface of the photosensitive member 1 mix into the developer on the development roller 32, being thereby moved away from the peripheral surface of the photosensitive member 1. Thereafter, the peripheral surface of the photosensitive member 1 is developed by the developer, being thereby prevented from causing the aforementioned fog. It should be noted here that, if peripheral velocity difference is provided between the development sleeve and the photosensitive member 1, the peripheral surface of the photosensitive member 1 is more evenly rubbed by the developer borne on the development sleeve, and therefore, the charging performance enhancement particles m on the photosensitive member 1 are recovered into the developing apparatus, leaving virtually no spot on the peripheral surface of photosensitive member 1 untouched. Thus, it is not likely that the charging performance enhancement particles m remain on the peripheral surface of the photosensitive member 1 after being rubbed by the developer borne on the development sleeve, and therefore, the fog is not likely to occur.

In summary, in this embodiment, the contact type developing apparatus 3 is employed as the developing means, and therefore, the peripheral surface of the photosensitive member 1 is developed after the charging performance enhancement particles m, having adhered to the peripheral surface of the photosensitive member 1, are first recovered into the developing apparatus 3. Thus, the developer is not adhered to the immediate adjacencies of the charging performance enhancement particles m having adhered to the peripheral surface of the photosensitive member 1.

Therefore, the photosensitive member 1 is desirably charged to achieve excellent image quality.

2. Comparison

In order to confirm the effectiveness of the above described embodiment in terms of fog prevention, a printer in this embodiment, that is, a printer equipped with the developing apparatus 3 in accordance with the present invention, was compared with another printer (comparative printer) equipped with a noncontact type developing apparatus.

The comparative printer is different from the printer in this embodiment only in that its developing apparatus is of a noncontact type.

In the case of the noncontact type developing apparatus employed in the comparative printer, a metallic development sleeve, as the developer bearing/conveying member, the peripheral surface of which is coated with carbon, is disposed so that the distance between the peripheral surfaces of the development sleeve and the photosensitive member 1 becomes 500 $\mu$m. The electrostatic latent image on the peripheral surface of the photosensitive member 1 is developed by applying to the developing sleeve, a development bias, that is, a compound voltage composed of a DC voltage of −420 V, and an AC voltage which has a rectangular wave-form, a frequency of 1,600 Hz, and a peak-to-peak voltage of 1,600 V, while rotating the development sleeve at a peripheral velocity equivalent to 100% of the peripheral velocity of the photosensitive member 1, without allowing any contact between the development sleeve and the photosensitive member 1.

In order to compare the two printers under the same conditions, in particular, in terms of the amount of the charging performance enhancement particles m on the photosensitive member 1, an excessive amount of the charging performance enhancement particles m was coated on the charge roller 2, so that the charging performance enhancement particles m remained adhered to the peripheral surface of the photosensitive member 1 past the charging station a. Therefore, the amount of the charging performance enhancement particles m on the peripheral surface of the photosensitive member 1 was larger than the normal amount.

Further, in order to find out the effect of the difference in the potential level to which the charging performance enhancement particles m were charged, upon image quality in terms of the fog, the potential level to which the charging performance enhancement particles m were charged was controlled by adjusting the elastic blade pressed upon the charge roller 2. In both printers, the amount of the charging performance enhancement particles m on the peripheral surface of the photosensitive member 1 before the developing station b was adjusted to approximately 50 particle/mm$^2$. As for the reference for evaluating the amount of the fog, the fog on a copy produced without adhering the charging performance enhancement particles m to the photosensitive member was used as the reference.

More specifically, the fog produced when a solid white image was printed was used as the reference. Table 1 shows the results of the evaluation of the copies in terms of the fog. In the table, the evaluations are represented with referential characters:

E: absolutely no fog

G: virtually no fog

F: slight fog

TABLE 1

| | NO DEPOSITION OF PROMOTION PARTICLES | CHARGE AMOUNT 1 (μC/g) | CHARGE AMOUNT 2 (μC/g) | CHARGE AMOUNT 3 (μC/g) |
|---|---|---|---|---|
| CHARGE AMOUNT OF PROMOTION PARTICLES | — | +0.5 | +1.5 | +2.5 |
| EMBODIMENT | E | E | E | E |
| COMP. EX. | E | E | G | F |

When no charging performance enhancement particles m were on the peripheral surface of the photosensitive member 1, the fog was not detected in either the printer in this embodiment or the comparative printer.

Also when the potential level of the charging performance enhancement particles m was low, no fog was detected in either the printer in this embodiment or the comparative printer.

However, as the potential level of the charging performance enhancement particles m was raised, the amount of the fog increased in the case of the comparative printer, whereas it did not increase in the case of the printer in this embodiment.

The increase in the amount of the fog, which occurred in the case of the comparative printer, can be assumed to have occurred for the following reason:

an electric field was formed around the charging performance enhancement particles m having adhered to the peripheral surface of the photosensitive member 1, and the developer adhered to the immediate adjacencies of the charging performance enhancement particles m. In comparison, in the case of the printer in this embodiment, the fog did not occur because the charging performance enhancement particles m having adhered to the peripheral surface of the photosensitive member 1 were rubbed away from the peripheral surface of the photosensitive member 1, in the developing nip.

In order to find out the effect of the peripheral velocity of the peripheral surface of the development sleeve relative to the peripheral surface of the photosensitive member 1, upon the fog, the peripheral velocity was varied. When the peripheral velocity of the development sleeve was 120% or more of the peripheral velocity of the photosensitive member 1, there was no problem in terms of the recovery of the charging performance enhancement particles m, and therefore, no fog appeared, whereas when it was no more than 120%, the recovery of the charging performance enhancement particles m became erratic, and as a result, the fog appeared.

This proves that the peripheral velocity of the development sleeve should be 120% or more relative to the photosensitive member 1 of the peripheral velocity. Further, when the peripheral velocity of the development sleeve exceeded 250% of the peripheral velocity of the photosensitive member 1, the developer was deteriorated and also scattered. Thus, the peripheral velocity of the development sleeve should be 250% or less of the peripheral velocity of the photosensitive member 1.

The above observation can be summed up as follows:

$$1.2<Vs/Vd<2.5$$

Vs: peripheral velocity of development sleeve

Vd: peripheral velocity of photosensitive member 1.

As long as the ratio of the peripheral surface of the development sleeve relative to that of the photosensitive member 1 remains in the range given above, the charging performance enhancement particles m can be recovered without missing any spot on the peripheral surface of the photosensitive member 1, and therefore, no fog is created.

(6) Automatic Feeding of Charge Performance Enhancement Particles from Developing Apparatus 3 to Charging Station a Even if a sufficient amount of the charging performance enhancement particles m is placed in advance in the charging station a, i.e., the nip between the photosensitive member 1 and the charge roller 2, or is coated in advance on the peripheral surface of the charge roller 2, the amount of the charging performance enhancement particles m in the charging station a, i.e., the nip between the photosensitive member 1 and the charge roller 2, gradually decreases, leading sometimes to the decline in the performance of the charging means.

Thus, in this embodiment, the charging performance enhancement particles m are placed in the developing apparatus 3, in addition to the developer, so that the charging performance enhancement particles m can first be supplied to the peripheral surface of the photosensitive member 1 from within the developing apparatus 3, and then, can next be supplied to the charging station a, i.e., the nip between the photosensitive member 1 and the charge roller 2, and/or to the charge roller 2, by way of the peripheral surface of the photosensitive member 1. As for the charging performance enhancement particles m, zinc oxide particles, which are chargeable to positive polarity, that is, the polarity opposite to that of toner, were used.

After escaping from the charging station a, the charging performance enhancement particles m are carried to the developing station b, in which they mix into the developer 31 on the developing apparatus side; in other words, they are recycled to be coated again on the peripheral surface of the photosensitive member 1. Since the charging performance enhancement particles m on the photosensitive member 1 are recovered by the developing apparatus 3, and then are coated again on the photosensitive member 1, the amount of the charging performance enhancement particles m is kept constant, preventing the balance between the developer and the charging performance enhancement particles m from being broken by consumption. Therefore, desirable charging performance is maintained for a long time. Further, since the charging performance enhancement particles m are recovered from the peripheral surface of the photosensitive member 1 and are recycled, the amount of the charging performance enhancement particles m does not continuously decrease by way of the charging station a and/or the charge roller 2, and therefore, desirable charging performance is maintained for a long time.

The charging performance enhancement particles m mixed into the developer 31 in the developing apparatus 3 are adhered to the peripheral surface of the photosensitive member 1, in the developing station b, and are carried, through the transferring station c, to the charging station a. In other words, they are automatically supplied to the charging station a and/or charge roller 2 to maintain desirable charging performance.

The developer image on the photosensitive member 1 aggressively transfers onto the recording medium P by being influenced by the transfer bias, in the transferring station c, whereas the charging performance enhancement particles m on the photosensitive member 1, being electrically conductive, do not aggressively transfer onto the recording medium P, remaining virtually adhered to the photosensitive member 1, and as the peripheral surface of the photosensitive member 1 moves, they are carried to the charging station a through the transferring station c.

The printer in this embodiment is cleanerless, and therefore, the developer and the charging performance enhancement particles m, which have remained on the peripheral surface of the photosensitive member 1 after image transfer, are directly carried to the charging station a.

It is desirable that a proper amount of the charging performance enhancement particles m is added in advance to the developer 31 in the developing apparatus 3 (for example, by the ratio of 100 parts in weight of toner to 0.01–20 parts in weight of charging performance enhancement particles m).

Embodiment 2 (FIG. 2)

The printer in this embodiment, which is shown in FIG. 2, is basically the same as the printer in the first embodiment (FIG. 1), except that this printer is equipped with a cleaning apparatus (cleaner) 7 which is placed between the transferring station c and the charging station a to clean the peripheral surface of the photosensitive member 1 by removing the residual developer, paper dust, or the like, from the peripheral surface of the photosensitive member 1. Since other portions of this printer are the same as those of the printer in the first embodiment, their description will be omitted to avoid repetition.

The cleaning apparatus 7 in this embodiment is a cleaning apparatus which employs a cleaning blade 71 to clean the photosensitive member 1. The cleaning blade 71 is an elastic blade formed of urethane rubber. The major portion of the developer which has remained on the peripheral surface of the photosensitive member 1 after image transfer, or the paper dust on the peripheral surface of the photosensitive member 1, are removed from the peripheral surface of the photosensitive member 1 by pressing this cleaning blade 71 against the photosensitive member 1.

Therefore, in comparison to the cleanerless printer, the amount, by which the post transfer residual developer, and the paper dust, are carried to the charging station a, mix with the charging performance enhancement particles m, remain adhered to the photosensitive member 1, in this printer, drastically reduces, reliably providing a desirable charging performance for realizing high image quality.

It should be pointed out here that although the image forming apparatus in this embodiment is equipped with the cleaning apparatus 7, the charging performance enhancement particles m are carried to the charging station a past the cleaning apparatus 7, because the charging performance enhancement particles m are smaller in particle diameter than the developer which remains on the peripheral surface of the photosensitive member 1 after image transfer, and the paper dust on the peripheral surface of the photosensitive member 1.

Therefore, even with the presence of the cleaning apparatus 7, the charging performance enhancement particles m mixed in the developer 31 in the developing apparatus 3 are borne on the peripheral surface of the photosensitive member 1, in the developing station b, and are carried to the charging station a past the transferring station c, as the peripheral surface of the photosensitive member 1 moves. In other words, the charging performance enhancement particles m are automatically supplied to the charging station a and the charge roller 2 to keep the charging performance at a desirable level.

Further, the charging performance enhancement particles m are always present between the cleaning blade 71 and the peripheral surface of the photosensitive member 1, preventing the cleaning blade 71 from being bent in the wrong direction by the friction between the cleaning blade 71 and the photosensitive member 1, and preventing the peripheral velocity of the photosensitive member 1 from being rendered irregular by the friction. Thus, desirable images can be produced.

It has been known that, in the case of a conventional image forming apparatus which employs the cleaning apparatus 7 equipped with the cleaning blade 71, if the peripheral surface of the photosensitive member 1 is inferior in terms of slipperiness, the cleaning blade 71 is sometimes bent in the wrong direction, or the rotational velocity of the photosensitive member 1 sometimes becomes irregular. However, in this embodiment, the peripheral surface of the photosensitive member 1 is excellent in terms of slipperiness, because the charging performance enhancement particles m borne on the peripheral surface of the photosensitive member 1 are present between the cleaning blade 71 and the photosensitive member 1. Therefore, it does not occur that the cleaning blade 71 is bent in the wrong direction by the friction between the cleaning blade 71 and the photosensitive member 1, or the rotational velocity of the photosensitive member 1 is rendered irregular by the friction.

Further, mixing the charging performance enhancement particles m into the developer 31 reduces the friction between the contact type developing apparatus and the photosensitive member 1, preventing the rotational velocity of the photosensitive member 1 from being rendered irregular by the friction between the development roller 32 and the photosensitive member 1. Therefore, it is possible to produce images which do not suffer from the defects traceable to the irregular rotational velocity of the photosensitive member 1.

Embodiment 3 (FIG. 3)

The printer illustrated in FIG. 3 is basically the same as the printer in the first embodiment (FIG. 1), except that the developing apparatus 3A in this embodiment is a contact type developing apparatus which uses two component developer. Since the other features of this printer are the same as those of the printers in the first embodiment, their descriptions will be omitted to avoid repeating the same descriptions.

The contact type developing apparatus 3A in this embodiment uses two component developer 35, which is a mixture of toner particles, and ferrite particles with a diameter of 40 $\mu$m. that is, carrier particles. This developer is borne on the developer bearing/conveying member 36, forming a magnetic brush layer 35*a*, by magnetic force, and is conveyed to the developing station b, in which the magnetic brush layer 35*a* is placed in contact with the peripheral surface of the photosensitive member 1 to develop in reverse the electrostatic latent image on the peripheral surface of the photosensitive member 1 by the toner particles. In other words, the developing apparatus 3A in this embodiment is a contact type developing apparatus which relies on a magnetic brush formed of two component developer. The toner particles in this embodiment are the same as those in the developer 31 in the first embodiment. In other words, they are negatively chargeable, nonmagnetic. dielectric, single component, latent image developing particles with an average particle diameter of 7 μm. The mixing ratio of the toner particles to the carrier particles is 7% in weight. The toner particles are triboelectrically charged, maintaining the electrical charge, as they are rubbed against the carrier particles.

A referential FIG. 36 designates a development sleeve as the developer bearing/conveying member with a diameter of 16 mm, and a referential FIG. 37 designates a magnetic roller as a magnetic field generating means fixed in the development sleeve 36. A referential FIG. 38 designates a developer layer regulating blade for forming a thin layer 35*a* of the developer on the peripheral surface of the developer sleeve 36.

The development sleeve 36 is positioned so that the closest distance (simply, "distance") between the peripheral surfaces of the development sleeve 36 and the photosensitive member 1 becomes approximately 500 pm. With this positioning, the developer layer 35*a* borne on the peripheral surface of the development sleeve 36 makes contact with the peripheral surface of the photosensitive member 1, forming a contact nip with a width of approximately 3 mm. This contact nip between the developer layer 35*a* and the peripheral surface of the photosensitive member 1 constitutes the developing station b.

The development sleeve 36 is rotatively driven about the magnetic roller 37 fixed in the development sleeve 36, at 150% of the peripheral velocity of the photosensitive member 1, in such a direction that the rotational directions of the development sleeve 36 and the photosensitive member 1 become the same in the developing station b. The two component developer 35 is held on the peripheral surface of the development sleeve 36 by the magnetic force of the magnetic roller 37, shaping into a brush form. As the development sleeve 36 is rotated, the developer layer 35*a*, i.e., the magnetic brush, borne on the development sleeve 36 is conveyed to the developing station b while being regulated in thickness by the blade 38. In the developing station b, the development layer 35*a* comes in contact with the peripheral surface of the photosensitive member 1, and then is returned into the developer container as the development sleeve 36 is further rotated.

When no peripheral velocity difference was provided between the development sleeve 36 and the photosensitive member 1, the charging performance enhancement particles m on the peripheral surface of the photosensitive member 1 could not be entirely recovered into the developing apparatus 3A. In other words, the charging performance enhancement particles m on some spots of the peripheral surface of photosensitive member 1 were missed, causing the fog, just as was the case in the first embodiment However, when the development sleeve 36 was rotated at 120% or more of the peripheral velocity of the photosensitive member 1, in such a direction that the rotational directions of the development sleeve 36 and the photosensitive member 1 became the same in the developing nip b, the charging performance enhancement particles m could be recovered without missing any spot on the peripheral surface of the photosensitive member 1. When the peripheral velocity of the development sleeve 36 exceeded 300% of the peripheral velocity of the photosensitive member 1, the developer carrier adhered to the peripheral surface of the photosensitive member 1, and/or the toner scattered. Based on the above observation, it is desirable that there is the following relation between the peripheral velocity Vs of the development sleeve 36 and the peripheral velocity Vd of the photosensitive member 1:

$$1.2<Vs/Vd<3.0.$$

With the peripheral velocity ratio between the development sleeve 36 and the photosensitive member 1 in the above range, the charging performance enhancement particles m can be spotlessly recovered, causing no fog.

When the development sleeve 36 was rotated at 100% or more of the peripheral velocity of the photosensitive member 1, in such a direction that the rotational directions of the development sleeve 36 and the photosensitive member 1 became different in the developing nip b, the charging performance enhancement particles m could be spotlessly recovered. When the rotational directions of the development sleeve 36 and the photosensitive member 1 were different in the developing nip b, and the peripheral velocity of the development sleeve 36 was 300% or higher, the developer carrier adhered to the peripheral surface of the photosensitive member 1, or the toner scattered, as occurred when the rotational directions were the same. Based on the above observation, it is desirable that the peripheral velocity Vs of the development sleeve 36 is no less than 100% of the peripheral velocity Vd of the photosensitive member 1, and no more than 300% of the same:

$$1.0<Vs/Vd<3.0.$$

When the ratio of the peripheral velocity of the development sleeve 36 to that of the photosensitive member 1 was within the above range, the charging performance enhancement particles m could be spotlessly recovered, causing no fog.

To the development sleeve 36, a DC voltage with a potential level of −420 V is applied as a development bias from a development bias power source 2.

In this embodiment, the charging performance enhancement particles m are mixed into the developer as in the first embodiment. Thus, the charging performance enhancement particles m are transferred onto the peripheral surface of the photosensitive member 1 in the developing nip b, and are supplied to the charging station a and the charge roller 2 by being borne on the peripheral surface of the photosensitive member 1, keeping charging performance at a desirable level, and also preventing the fog, as they did in the first embodiment.

In addition, the toner particles in the developer 35 are given triboelectrical charge as they rub against the charging performance enhancement particles m. The following should be noted here:

because the charging performance enhancement particles m are smaller in diameter than the carrier particles, they can rub the toner particles more thoroughly and proficiently than the carrier particles, reliably giving electrical charge to the toner particles. In other words, the toner particles become more uniform in terms of potential level, and therefore, developing performance remains stable.

Further, the friction between the developing apparatus 3A and the photosensitive member 1 could be reduced as the friction between the developing apparatus 3 and the photosensitive member 1 was in the second embodiment. Therefore, the rotational velocity of the photosensitive member 1 and development sleeve 36 did not become irregular, preventing image defects traceable to the irregularity in the rotational velocity of the photosensitive member 1 or development sleeve 36.

As described above, in this embodiment, the charging performance enhancement particles m were mixed into the two component developer 35 in the contact type developing apparatus, and therefore, the charging performance was improved, and also, the developing performance was stabilized.

In this embodiment, the development sleeve 36 is rotated so that the rotational direction of the development sleeve 36 becomes the same as that of the photosensitive member 1, at the interface between the two. However, the rotational directions of the development sleeve 36 and the photosensitive member 1 in the interface may be counter to each other. In the latter case, the charging performance enhancement particles m on the peripheral surface of the photosensitive member 1 are more efficiently mixed back into the developer 35, and the effect of the charging performance enhancement particles m in terms of the friction reduction between the developing apparatus 3A and the photosensitive member 1 also increases.

As is evident from the above description, not only does the mixing of the charging performance enhancement particles m into the two component developer 35 used with the contact type charging apparatus 3A improve the charging performance, but it also prevents the fog traceable to the adhesion of the charging performance enhancement particles m to the photosensitive member 1.

Miscellaneous Embodiments

1) The structure of an image forming apparatus does not need to be limited to those described in the preceding embodiments, in which the charge roller 2 was used as the elastic contact type charging member.

For example, a fur brush may be used as the flexible contact type charging member. Further, the contact type charging member may be different from the charge roller 2 in material as well as shape: a piece of felt or fabric may be used. These materials may be placed in layers to provide better elasticity and electrical conductivity.

In the charge injection mechanism of a contact type charging system, the state of contact between the contact type charging member and the object to be charged greatly affects the charging performance of the mechanism. Therefore, the state of contact between the contact type charging member and the object to be charged should be as tight as possible, and the contact type charging member should have as much peripheral velocity difference from the object to be charged as possible, so that a unit area of the peripheral surface of the object to be charged comes in contact with as much area of the peripheral surface of the contact charging member as possible.

Further, an object to be charged may be provided with a charge injection layer as a top layer to adjust the surface resistance of the object to be charged, so that the charge injection mechanism plays the dominant role in charging the object with the use of the contact type charging system.

FIG. 4 is an enlarged schematic section of the photosensitive member 1, and depicts the laminar structure of the photosensitive member 1, the surface layer of which is a charge injection layer 16. More specifically, this photosensitive member 1 comprises a base member 11 constituted of a piece of aluminum drum, and five functional layers: a undercoat layer 12, a positive charge injection prevention layer 13, a charge generation layer 14, a charge transfer layer 15, and the charge injection layer 16, which are laminated in the listed order on the aluminum base 11. In other words, the photosensitive member 1 in this embodiment consists of an ordinary organic photosensitive member, and the charge injection layer 16 is coated thereon as the surface layer to improve it in charging performance.

The charge injection layer 16 is composed of photo-curing acrylic resin as binder, microscopic particles 16*a* of SnO2 as conductive particles (0.03 $\mu$m in approximate diameter), tetrafluoroethylene (Teflon) or the like as lubricating agent, polymerization initiator, and the like. In manufacturing the photosensitive member 1 in this embodiment, the above listed ingredients are mixed, and the mixture is coated on an ordinary organic photosensitive member. The coated layer of the mixture is photo-cured.

One of the important aspects of the charge injection layer 16 as the surface layer is its electrical resistance. In a charging system in which charge is directly injected, the efficiency with which the charge given by the charging member is received by the object to be charged, can be increased by reducing the electrical resistance of the object to be charged. However, because the photosensitive member 1 must be able to hold an electrostatic latent image for a certain length of time, the volumetric resistivity of the charge injection layer 16 should be in a range of $1\times10^{9}$–$1\times10^{14}$ Ω·cm. The volumetric resistivity of the charge injection layer 16 was obtained by measuring a sample of charge injection layer 16 in the sheet form with the use of High Resistance Meter 4329A (Yokogawa-Hewlet-Packard Co., Ltd.), and Resistivity Cell 16008A (Yokogawa-Hewlet-Packard Co., Ltd.) connected to High Resistance Meter 4329A.

It should be noted here that even if an organic photosensitive member is not provided with the charge injection layer 16 as the photosensitive member 1 in this embodiment is provided, an effect equivalent to the one provided by the charge injection layer 16 can be provided by the charge transfer layer 15, for example, as long as the volumetric resistivity of the charge transfer layer 15 is within the aforementioned volumetric resistivity range.

3) When an AC voltage is applied to a contact type charging member, a developing apparatus, or the like, the wave-form of the AC voltage may be a sine wave-form, a rectangular wave-form, a triangular waveform, etch; it is optional. It may be such an AC voltage with a rectangular wave-form that is generated by periodically turning on and off a DC power source. In other words, the wave-form of the voltage does not matter; various types of voltage can be used as the charge bias as long as their potential levels periodically change.

4) The choice of the exposing means for forming an electrostatic latent image does not need to be limited to the scanning layer beam based exposing means employed in the preceding embodiment, which formed a digital latent image. It may be an analog exposing means, or means consisting of light emitting elements such as LED's. Further, it may be a combination of a light source such as a fluorescent light or the like, and a liquid crystal shutter or the like. In other words, any means is acceptable as long as it can form a latent image which accurately reflects image data.

The image bearing member 1 may be an electrostatically recordable dielectric member or the like. In such a case, the surface of the dielectric member is uniformly charged to predetermined polarity and potential level (primary charge), and then, the latent image of a target image is written on the charge surface by selectively removing the charge with the use of a charge removing means such as a head with a discharger needle, an electron gun, or the like.

5) Also in the case of the developing means 3 and 3A, the choice of the developing system and structure does not need to be limited to those in the preceding embodiments, which is obvious. For example, a normally developing means may be employed.

5) An image forming apparatus may be equipped with a direct image formation system, instead of an image transfer system. In such a case, a sheet of photosensitive paper or electrostatic recording paper is used as an image bearing member, and an image is directly formed on the image bearing member, that is, without going through the transfer process, after the surface of the photosensitive paper or the electrostatic recording paper is charged by a contact type charging system.

The recording medium, which receives the developer image transferred from the image bearing member 1, may be an intermediary transfer member such as a transfer drum.

8) An example of a method for measuring the particle size of the developer 31 (toner) or the charging performance enhancement particles m is as follows: as for the measuring apparatus, Coulter Counter TA-2 (Coulter Co., Ltd.) is used. To this measuring apparatus, an interface (Nikka Ki Co., Ltd.) which outputs the number average distribution and the volumetric average distribution, and a personal computer CX-1 (Canon) are connected. As for the electrolyte, 1% water solution of first class sodium chloride (NaCl) is used.

In measuring the particle size, surfactant, desirably, 0.1–5 ml of alkylbenzensulfonate, is added to 100–150 ml of the aforementioned electrolyte, and then, 0.5–50 mg of the particle sample is added to the mixture.

The electrolyte in which the particle sample is suspended is subject to an ultrasonic dispersing device for approximately 1–3 minutes to evenly disperse the particles. Then, the particle size is measured with the aforementioned Coulter counter TA-2, the aperture of which has been adjusted to 100 $\mu$m, to obtain the volumetric average distribution of the particles, the size of which is in a range of 2–40 $\mu$m. The volumetric average particle diameter is calculated from the thus obtained volumetric average distribution.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a charging device for charging said image bearing member, said charging device including a charging member for being supplied with a voltage and for forming a nip with said image bearing member and including electroconductive particles in said nip;

developing means for developing, with one-component developer, an electrostatic latent image formed on said image bearing member using said charging device; said developing means including a developer carrying member for carrying the developer, wherein the developer carried on said developer carrying member during a developing operation is contacted to said image bearing member at a contact position where peripheral movement directions of said image bearing member and said developer carrying member are the same, and wherein a surface speed of said image bearing member Vd and a surface speed of said developer carrying member Vs satisfy:

$$1.2<Vs/Vd<2.5,$$

wherein the electroconductive particles have a particle size which is not more than one half that of the developer.

2. An apparatus according to claim 1, wherein said charging member is driven at such a speed that a speed difference is provided between said charging member and said image bearing member.

3. An apparatus according to claim 1, wherein said charging member is provided with a surface flexible member.

4. An apparatus according to claim 1, wherein the electroconductive particles are supplied from said developing means to said image bearing member, and is fed to said nip by said image bearing member.

5. An apparatus according to claim 1 or 4, wherein a charging polarity of the electroconductive particles is opposite from that of the developer.

6. An apparatus according to claim 1, wherein the electroconductive particles have a volume resistivity which is not more than $1\times10^{12}$ Ohm.cm.

7. An apparatus according to claim 1, wherein the electroconductive particles have a volume resistivity which is not more than $1\times10^{10}$ Ohm.cm.

8. An apparatus according to claim 1, wherein said developing means removes residual developer from said image bearing member simultaneously with developing the electrostatic image with the developer.

9. An apparatus according to claim 1, wherein said charging device effects injection charging for said image bearing member.

10. An apparatus according to claim 1, wherein said image bearing member is provided with a surface layer having a volume resistivity of $1\times10^{9}$–$1\times10^{14}$ Ohm.cm.

11. An apparatus according to claim 1, wherein said charging member is in the form of a roller.

12. An image forming apparatus comprising:

an image bearing member;

a charging device for charging said image bearing member, said charging device including a charging member for being supplied with a voltage and for forming a nip with said image bearing member and including electroconductive particles in said nip;

developing means for developing, with a developer comprising toner and carrier particles, an electrostatic latent image formed on said image bearing member using said charging device; said developing means including a developer carrying member for carrying the developer, wherein the developer carried on said developer carrying member during a developing operation is contacted to said image bearing member at a contact position where peripheral movement directions of said image bearing member and said developer carrying member are the same, and wherein a surface speed of said image bearing member Vd and a surface speed of said developer carrying member Vs satisfy:

$$1.2<Vs/Vd<3.0,$$

wherein the electroconductive particles have a particle size which is not more than one half that of the toner.

13. An apparatus according to claim 12, wherein said charging member is driven at such a speed that a speed difference is provided between said charging member and said image bearing member.

14. An apparatus according to claim 12, wherein said charging member is provided with a surface flexible member.

15. An apparatus according to claim 12, wherein the electroconductive particles are supplied from said developing means to said image bearing member, and is fed to said nip by said image bearing member.

16. An apparatus according to claim 12 or 15, wherein a charging polarity of the electroconductive particles is opposite from that of the toner.

17. An apparatus according to claim 12, wherein the electroconductive particles have a volume resistivity which is not more than $1\times10^{12}$ Ohm.cm.

18. An apparatus according to claim 12, wherein the electroconductive particles have a volume resistivity which is not more than $1\times10^{10}$ Ohm.cm.

19. An apparatus according to claim 12, wherein said developing means removes residual developer from said image bearing member simultaneously with developing the electrostatic image with the developer.

20. An apparatus according to claim 12, wherein said charging device effects injection charging for said image bearing member.

21. An apparatus according to claim 12, wherein said image bearing member is provided with a surface layer having a volume resistivity of $1\times10^{9}$–$1\times10^{14}$ Ohm.cm.

22. An apparatus according to claim 12, wherein said charging member is in the form of a roller.

23. An image forming apparatus comprising:

an image bearing member;

a charging device for charging said image bearing member, said charging device including a charging member for being supplied with a voltage and for forming a nip with said image bearing member and including electroconductive particles in said nip;

developing means for developing, with a developer comprising toner and carrier particles, an electrostatic latent image formed on said image bearing member using said charging device; said developing means including a developer carrying member for carrying the developer, wherein the developer carried on said developer carrying member during a developing operation is contacted to said image bearing member at a contact position where peripheral movement directions of said image bearing member and said developer carrying member are opposite from each other, and wherein a surface speed of said image bearing member Vd and a surface speed of said developer carrying means Vs satisfy:

$$1.2<Vs/Vd<3.0,$$

wherein the electroconductive particles have a particle size which is not more than one half that of the toner.

24. Ani apparatus according to claim 23, wherein said charging member is driven at such a speed that a speed difference is provided between said charging member and said image bearing member.

25. An apparatus according to claim 23, wherein said charging member is provided with a surface flexible member.

26. An apparatus according to claim 23, wherein the electroconductive particles are supplied from said developing means to said image bearing member, and is fed to said nip by said image bearing member.

27. An apparatus according to claim 23 or 26, wherein a charging polarity of the electroconductive particles is opposite from that of the toner.

28. An apparatus according to claim 23, wherein the electroconductive particles have a volume resistivity which is not more than $1\times10^{12}$ Ohm.cm.

29. An apparatus according to claim 23, wherein the electroconductive particles have a volume resistivity which is not more than $1\times10^{12}$ Ohm.cm.

30. An apparatus according to claim 23, wherein said developing means removes residual developer from said image bearing member simultaneously with developing the electrostatic image with the developer.

31. An apparatus according to claim 23, wherein said charging device effects injection charging for said image bearing member.

32. An apparatus according to claim 23, wherein said image bearing member is provided with a surface layer having a volume resistivity of $1\times10^{9}$–$1\times10^{14}$ Ohm.cm.

33. An apparatus according to claim 23, wherein said charging member is in the form of a roller.

* * * * *

UNITED STATES PATENT AND TRADEMARK OFFICE

CERTIFICATE OF CORRECTION

PATENT NO. : 6,118,965

DATED : September 12, 2000

INVENTORS : JUN HIRABAYASHI, et al.

It is certified that error appears in the above-identified patent and that said Letters Patent is hereby corrected as shown below:

COLUMN 7

Line 2, "based" should read --based on--.

COLUMN 8

Line 38, "xmm/sec." should read --mm/sec.--.

COLUMN 9

Line 62, "opposi'te" should read --opposite--.

COLUMN 11

Line 5, "It" should read --if--.

COLUMN 14

Line 13, "member i" should read --member 1--; and
Line 35, "a-mount" should read --amount--.

COLUMN 16

Line 23, "Is" should read --is--;
Line 25, "D," should read --b,--; and
Line 26, "leaned" should read --cleaned--.

UNITED STATES PATENT AND TRADEMARK OFFICE

CERTIFICATE OF CORRECTION

PATENT NO. : 6,118,965

DATED : September 12, 2000

INVENTORS : JUN HIRABAYASHI, et al. Page 2of 2

It is certified that error appears in the above-identified patent and that said Letters Patent is hereby corrected as shown below:

COLUMN 25

Line 63, "SnO2" should read --$SnO_2$--.

COLUMN 26

Line 16, "Hewlet-" should read --Hewlett--; and
Line 17, "Hewlet-" should read --Hewlett--.

COLUMN 28

Line 60, "is" should read --are--.

COLUMN 30

Line 4, "Ani" should read --An--;
Line 13, "is" should read --are--; and
Line 23, "$1x10^{12}$" should read --$1x10^{10}$--.

Signed and Sealed this

Eighth Day of May, 2001

*Attest:*

Nicholas P. Godici

NICHOLAS P. GODICI

*Attesting Officer*

*Acting Director of the United States Patent and Trademark Office*